US005206957A

United States Patent [19]

Gulick

[11] Patent Number: 5,206,957

[45] Date of Patent: May 4, 1993

[54] BODY CORE WARMING VEST

[76] Inventor: Betty Gulick, 2398 Forecastle Ct., Woodbridge, Va. 22192

[21] Appl. No.: 892,583

[22] Filed: Jun. 3, 1992

[51] Int. Cl.[5] ..... A41D 1/04

[52] U.S. Cl. ..... 2/84; 2/69; 2/73; 2/75; 2/77; 2/78 R; 2/78 B; 2/102; 2/111; 2/113; 2/114; 2/115

[58] Field of Search ..... 2/84, 69, 70, 71, 72, 2/73, 75, 77, 78 R, 78 B, 102, 111, 113, 114, 115, 127, 128, 129

[56] References Cited

U.S. PATENT DOCUMENTS

| | | | |
|---|---|---|---|
| 1,117,525 | 11/1914 | Schlesinger | 2/77 |
| 1,260,873 | 3/1918 | Colman | 2/111 |
| 2,363,959 | 11/1944 | Hanes . | |
| 2,789,290 | 4/1957 | Mayer . | |
| 3,144,661 | 8/1964 | Buser | 2/84 |
| 3,840,900 | 10/1974 | Cruz | 2/77 |
| 4,100,620 | 7/1978 | Pecoraro . | |
| 4,149,272 | 4/1979 | Maeshima . | |
| 4,716,598 | 1/1988 | Bertram | 2/102 |
| 5,031,244 | 7/1991 | Inagaki | 2/102 |
| 5,038,779 | 8/1991 | Barry et al. | 2/102 |
| 5,048,122 | 9/1991 | Prieur . | |

FOREIGN PATENT DOCUMENTS

| | | | |
|---|---|---|---|
| 57753 | 12/1911 | Switzerland | 2/84 |
| 15395 | of 1894 | United Kingdom | 2/77 |
| 699143 | 10/1953 | United Kingdom | 2/77 |

*Primary Examiner*—Clifford D. Crowder
*Assistant Examiner*—Gloria Hale
*Attorney, Agent, or Firm*—Nixon & Vanderhye

[57] ABSTRACT

A one-piece, snug fitting, sleeveless garment covering the core or torso of the body is intended to be worn by persons susceptible to cold and chills. The garment includes plural layers, including an insulative intermediate layer, and a hood integrally connected to the garment. The garment opens flat to enable the wearer to be easily clad in the garment.

17 Claims, 5 Drawing Sheets

BODY CORE WARMING VEST

FIELD OF THE INVENTION

The present invention relate to one-piece, snug fitting garments which may be worn beneath outer garments in direct contact with the skin which will provide comforting warmth to individuals that are susceptible to cold and chills.

BACKGROUND AND SUMMARY OF THE INVENTION

The elderly, patients in long term health care facilities and hospitals, individuals having poor circulation, all oftentimes suffer from persistent chills, despite being indoors or wearing several layers of clothing. Providing breathable, snug fitting wearing apparel that is both comfortable and warm, improves the general demeanor of persons and helps ward off disease and sickness associated with being cold much of the time.

Patients in long term care facilities or hospitals may also at times need therapeutic aids or other medical treatment which would preclude them from wearing sufficient layers of clothing to keep warm. Such procedures as catheterization may also prevent a patient from being fully clothed, thereby increasing the potential exposure of the patient to cold and chills (and possible embarrassment) should the blankets be removed or lost.

In the past, hospital garments were likely to be crotchless in order to facilitate access to the patient or alternatively, garments were provided with fully removable crotch panels which were to be reattached but which often become lost or separated once removed. Furthermore, if a patient requires therapeutic treatment, such as localized heating, traction or the like, he or she may have to be immobilized while in contact with the therapeutic aid (e.g. heating pad, weights), thus precluding free movement within his or her environment. The inability to move about freely may have the additional deleterious effect of slowing circulation of the blood while the patient is sedentary (not to mention the discomfort of having to lie still for a prolonged period in a stationary position).

Garments typically provided to patients by long term care facilities and hospitals are often loose fitting, and may only be secured to the wearer by ties, or may simply be a "wrap around" type covering. These garments are often constructed of an inexpensive, single layer of fabric material, such as cotton, and are thus not very insulative. In addition, such garments, which are selected more for the convenience of the staff than for the comfort of the patient, are generally only intended to be worn temporarily and are utilized as they are easily removed to enable the patient to be bathed and examined or treated. However, the wearer of these garments, while receiving some warmth, may still feel chills and be uncomfortable, as the loose fit of these wrap type garments may make the wearer feel awkward or timid in his or her movement due to the increased risk of exposure.

The importance of keeping the core and head of the body warm has been known for many years. For example, some body-fitting "wet suits" used by skin divers cover only the diver's torso and not the diver's arms or legs. A zipper may be provided (e.g., down the front of the wet suit) to permit the diver to get into and out of the suit. Some such wet suits may also include a hood covering the diver's head. The "wet suit" is made of special molded water-resistant material and employs a layer of water trapped between the suit and the diver's body to insulate the body's core from the cold water surroundings encountered during dives. Thus, such "wet suits" cannot be readily adapted for use above the water's surface, and are incompatible with the needs of the elderly and the infirm.

For example, persons suffering from cold or chills often do not think to cover their heads as much body heat is lost from this region of the body. Oftentimes, head coverings are generally not considered by the individual as they may be cumbersome to the wearer or may simply become misplaced and at the time, it may be inconvenient to locate a suitable replacement. This is especially true in care facilities (e.g. nursing homes and hospitals), where during the laundering of patient clothing, the matching hat and outfit may become separated, or staff personnel or the patient may simply lose the head covering.

Other garments which may be provided to persons residing at such care facilities may have exposed or raised stitching. The seams of such garments may have an abrasive effect or simply may be an additional annoyance when the clothing is worn close to the skin, thus causing additional irritation. Furthermore, such exposed stitching may become caught on furniture or other medical appliances causing tears and precipitating the early demise of the garment. Moreover, garments having such exposed stitching may breakdown much more readily during repeated laundering.

Hospital garments typically do not have snug fitting openings for the wearer's appendages. Thus when the wearer moves his or her arms, legs or neck, gaps between the skin of the wearer and the garment appear causing valuable body heat to be lost and the a chill to be felt. It is known to provide elastic bands around the openings of some garments. However, the tightness with which the bands grasp the limbs of the wearer may limit circulation or rub against sensitive skin causing a temporary deformation of the skin due to the pressure of the bands. In addition, the elastic band surrounding these openings may break during repeated use or laundering.

Cold is an age-old problem, and much effort has been devoted in the past to developing heat-insulative garments.

For example, many different types of thermal underwear are available. Such thermal underwear typically comprises a single layer of tight-fitting, breathable, insulative undergarment worn in direct skin contact beneath other clothing. Separate thermal underwear garments are often provided for upper and lower body portions, although one-piece constructions (e.g., the "union suit" that is ubiquitous in colder regions of the world) are known. Known thermal underwear generally cannot be opened flat and is thus often difficult or impossible (and at least frustrating and time-consuming) for an elderly or infirm person to use. In addition, hospitals and long-term care facilities may discourage the use of thermal underwear because it restricts access to bedridden patients for routine or emergency medical procedures.

The following is a non-exhaustive listing of prior issued patents relating to wearing apparel:

| Patent No. | Patentee | Issue Date |
|---|---|---|
| 2,363,959 | Hanes | Nov. 28, 1944 |
| 2,789,290 | Mayer | Apr. 23, 1957 |
| 3,144,661 | Buser | Aug. 18, 1964 |
| 4,100,620 | Pecoraro | Jul. 18, 1978 |
| 4,149,272 | Maeshima | Apr. 17, 1979 |
| 4,716,598 | Bertram | Jan. 5, 1988 |
| 5,048,122 | Prieur | Sep. 17, 1991 |

Buser U.S. Pat. No. 3,144,661 discloses a heavy flannel cotton hospital garment having a single layer construction with an integral hood. The garment is sleeved and opens flat so that it may be readily applied to and removed from the patient. The Buser patent discloses a garment similar to the conventional wrap type covering, which is utilized more for the convenience of the staff than for the patient. The garment is loose fitting, is secured only by ties and has only single layer construction. In addition, no crotch portion is provided (the bottom portion of the garment being completely loose and unsecured). Furthermore, the Buser wrap with its sleeves, may restrict the movement of the patient.

Maeshima U.S. Pat. No. 4,149,272 discloses an insulative skiers' vest having quilted front and back panels. A pocket disposed at the lower dorsal portion of the vest contains a supplemental, hooded jacket. The vest is not snug fitting so as to allow freedom of movement by the skier. In addition, the vest is not worn close to the skin, but rather it is intended to be worn as an outer garment which would have moisture proof characteristics. The vest has no surrounding crotch panel, and no integral hood is provided.

Prieur U.S. Pat. No. 5,048,122 relates to a one-piece, soft cotton garment for infants requiring prolonged medical treatment, and includes a zippered fastener extending most of the way down the front. Also disclosed is a fastenable crotch portion, a pocket for retaining catheter lines, and arm, neck and leg openings. Prieur however does not show an integral hood, or a multi-layered construction. In addition, Prieur cannot be opened flat to enable non-ambulatory patients to be easily dressed and undressed.

Hanes U.S. Pat. No. 2,363,959 relates to a one-piece, sleeveless under garment construction having a fastenable crotch portion. The garment, which is constructed from a single layer of knitted fabric, is slipped over the head of the wearer and then the crotch panel is secured by snap type fasteners. The Hanes undergarment lacks a hood, to provide warmth to the wearer's head. In addition, the undergarment is not capable of being opened flat as the garment has to be slipped on over one's head.

Mayer U.S. Pat. No. 2,789,290 discloses a one-piece garment construction having a fully removable crotch panel and a series of buttons extending down most of the front panel of the garment. Leg receiving recesses are also provided. The crotch panel is fully detachable, and thus may be lost during laundering and transport. Furthermore, the "blouse-shirt" is provided with sleeves and cannot be opened flat to encircle the wearer.

Pecoraro U.S. Pat. No. 4,100,620 relates to a semi-rigid, multi-layer vest type body protector having a layer of cotton padding locked in place to an inner layer by a quilting stitch. Pecoraro's vest is designed to provide a loose fitting, semi-rigid garment which is capable of absorbing the impact of a ball. Such a garment which would likely be uncomfortable and unsuitable to a patient in a care facility, is not designed to provide warmth to the wearer. In addition, the Pecoraro vest does not require a fastenable crotch panel, nor does it provide an integral hood for the wearer.

Bertram U.S. Pat. No. 4,716,598 relates to an insulative fabric having synthetic beads contained in individual cells. The beads when dry create a static charge, and when wet prevent the accumulation of moisture. The fabric is not intended for patient care, as it is intended to provide an outer covering for the wearer and thus is not intended to be worn next to the skin. The Bertram garment suffers from many of the same deficiencies as the Pecoraro vest referenced above.

Thus, while much work has been done in this area in the past, further improvements are possible. For example, there is a need for a one-piece, close-fitting, sleeveless garment that can be snugly worn in direct contact to the skin so as to keep the core of the body warm—but which can be easily opened flat to provide access to the body for medical procedures, washing or changing clothes.

According to one aspect provided by the present invention, a one-piece, snug-fitting, sleeveless garment for use as a body core warming vest is provided. The vest comprises at least one sheet of a breathable material; and at least one layer of insulative material secured to the sheet. A collar may be integrally connected to the sheet, and is constructed of a material having an elastic facing so as to provide ease of movement and adjustable fit for the wearers' neck. A hood is integrally connected to the collar for providing warmth to the wearer's head. A detachable crotch panel having first and second ends includes closure means for detachably attaching one of the ends to the sheet of material. Arm, neck and leg openings having an elastic facing may provide a gathered, adjustable snug fit around each of the arms and legs of the wearer. The body core warming vest further includes body conforming closure means on the sheet to secure the core warmer snugly to the wearer. The body conforming closures can be easily opened so as to open the vest flat—thereby permitting easy dressing and undressing.

Another aspect provided by the present invention is to provide a multi-layered garment construction. The layers are preferably secured by double seam stitching which creates flat seams and a pillowy soft cushion in the sheet material to prevent the wearer's skin from coming into contact with the seams, thereby precluding the abrasive interaction which seams may sometimes cause.

Another aspect of the present invention is to provide a snug fitting garment having a therapeutic aid carrying means configured, dimensioned and placed so that therapeutic aids may be conveniently positioned for treatment of the patient and carried with the patient as he or she moves. The therapeutic aid carrying means may also be provided with a flap and associated closure means to secure the therapeutic device within the carrying means.

Another aspect of the present invention provides a releasably attached crotch panel so that a patient may be fitted for medical procedures, such as catheterization, without the fear of losing any protective covering or having to be undressed for the procedure. The crotch panel is preferably releasably secured only along one end, thereby preventing the crotch panel from being lost during laundering or transport of the garment.

A still further aspect of the present invention provides a snug fitting garment which may be opened flat to enable a wearer or non-ambulatory patient to be easily clothed in the garment in order to provide sufficient comfort and warmth as well as to provide immediate access to the patient for emergency or routine medical procedures or examinations.

BRIEF DESCRIPTION OF THE DRAWINGS

These and other features and advantages of the present invention may be more completely understood by referring to the following detailed description of the presently preferred exemplary embodiments in conjunction with the drawings, of which.

DETAILED DESCRIPTION OF THE PRESENTLY PREFERRED EXEMPLARY EMBODIMENTS

Figure 1:
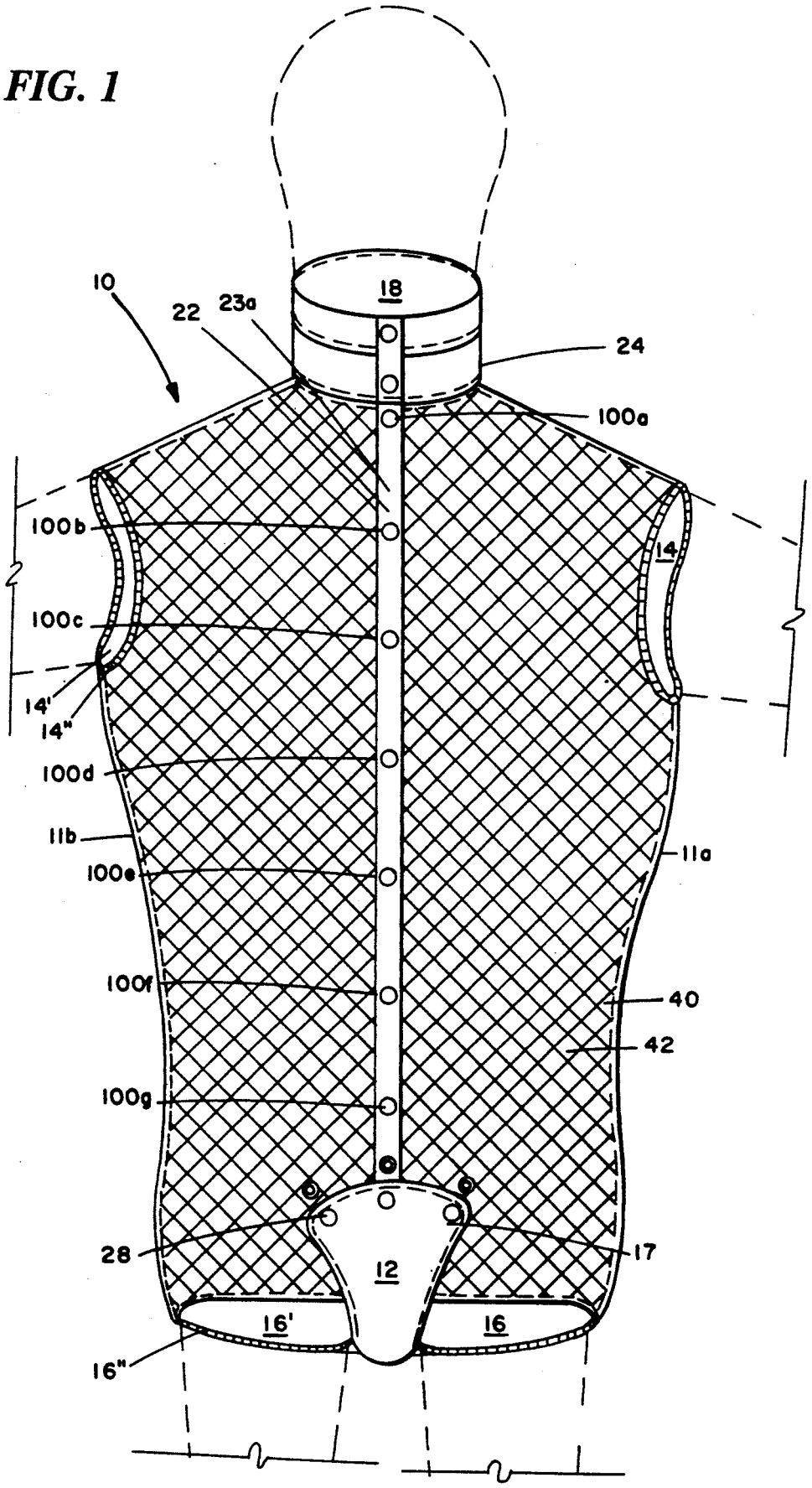
FIG. 1 is a front perspective view illustrating a garment constructed in accordance with the presently preferred exemplary embodiment provided by the present invention.
Figure 2:
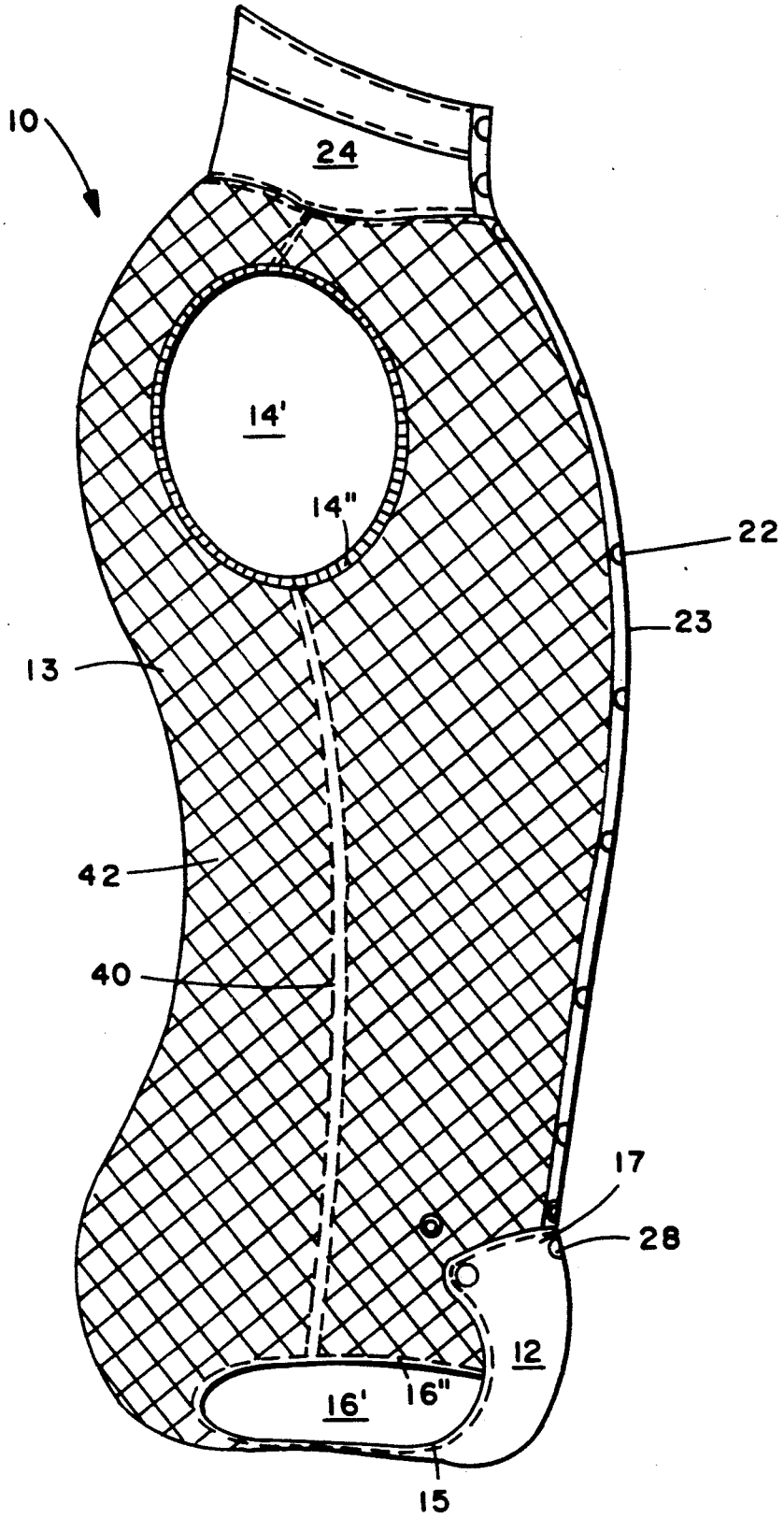
FIG. 2 is a side perspective view of the garment shown in FIG. 1.

FIGS. 1 and 2 illustrate a one-piece, sleeveless, multi-layered garment 10 used to provide warmth to the core or torso of the human body. Garment 10 has front and back panels 11 and 13 (see FIG. 2), respectively. Garment 10 is intended to be worn as an undergarment in direct contact with the wearer's skin. The panels 11 and 13 of the garment 10 are each constructed of a breathable fabric which enables the skin of the wearer to breathe. As illustrated in FIG. 1, garment 10 is form-fitting and is preferably tailored to fit the general shape of the torso of wearer. By making a garment to fit the torso of the particular wearer within close tolerances, the creation of snug fit is insured, thereby increasing the overall comfort to the wearer due to increased, high insulative effectiveness, which decreases bulkiness. In addition, the garment 10 is constructed by double stitching 40 (FIGS. 1 and 2) to create a quilted appearance. The double stitching 40 creates soft, pillowy cells 42 which provide greater comfort to the wearer.

The garment 10 is provided with a detachable crotch panel 12 having first and second ends 15 and 17, respectively (see FIG. 2). The crotch panel 12 may be constructed of the same multi-layered material as the garment 10, or alternatively, may only have a single layer construction. In addition, the crotch panel 12 may have a configuration similar to that of an hour glass or double, reversed silhouette to provide a more comfortable fit between the thighs of the wearer. Crotch panel 12 is securely fastened to rear panel 13 along the first end 15 and releasably fastened along the second end 17 to front panel 11 by closure elements 28 (e.g. snaps). The releasable closure means 28, disposed along one end 17 can be easily opened by the wearer. Fixed attachment of crotch panel end 15 to panel 13 insures that the crotch panel 12 will not be separated from the garment 10 during laundering or transport. By providing a releasably attached crotch panel 12, the patient need not be undressed when undergoing catheterization, thereby retaining most of the body's warmth while facilitating the needs of the medical staff. However, the crotch panel 12 will not become lost when it is unfastened for insertion of a catheter tube as the panel 12 is securely fastened along the first end 15 to the back panel 13.

Garment 10 is provided with a body conforming closure means 22 configured so as to conform the garment to the shape of the body and provide a form-fitting, snug and secure fit. In a preferred embodiment, front panel 11 comprises first and second portions 11*a*, 11*b* and closure means 22 detachably secures the first and second front portions together. The closure means 22 includes, in the preferred embodiment, a longitudinally extending strip 23, attached to front panel portion 11*a*, having plural individual closure elements 100 therealong and a similar longitudinally extending strip 23*b* (not shown) attached to front panel 11*b* that includes plural closure elements that correspond and mate with closure elements 100. Strips 23*a*, 23*b* preferably extend over the entire front length of panel 13 from collar region 24 to the crotch panel 12—thereby creating a complete gapless closure sealing together of front panels 11*a*, 11*b* so as to prevent heat loss. Closure elements 100*a*, 100*g* are preferably sufficiently closely spaced to one another to prevent gaps from forming in the form-fitting body covering provided by front panel 13 as the wearer changes position. The closure means 22 may be any typical garment fasteners, such as snaps, zippers, buttons, clasps, hook and loop type fasteners or the like, but preferred are closure means having a reliable inter-mating relationship (e.g. male/female such as in a snap) that is easy for even arthritic hands to open and close. A suitable backing material (not shown) may be provided on the interior of the closure fastening strip 23 (see FIG. 2) to insure that the fasteners do not irritate or rub against the skin of the wearer. The closure fastening strip 23 may be constructed from the same material as that of the front and back panels 11 and 13 respectively.

As mentioned above, body conforming closure means 22 extends longitudinally of the entire length of the front panel 11, and into collar 24. The closure elements 28 of the crotch panel 12 are separate from closure elements 22 so that the garment 10 need not be opened in order to accommodate for the care or treatment of the patient or to provide for the individual needs of the wearer. In addition, the closure elements 28 of the crotch panel 12 are disposed substantially perpendicularly to the closure elements 22 of the front panel 11 for added lateral support and strength for the lower abdominal portion of the garment 10. This substantially perpendicular arrangement conforms to the lower abdomen of the patient thereby increasing the body conforming fit of the garment. Likewise, the longitudinal arrangement of the fasteners 22 along the front panel 11 conforms to the torso of the patient.

Garment 10 has sleeveless openings 14, and 14' for the arms, of the wearer (and in conjunction with crotch panel 12) provides openings 16 and 16' for the legs of the wearer. An additional opening 18 (FIG. 1) is provided for the wearer's neck. Each of the openings 14, 14', and 16, 16', are provided with an elastic facing which creates, in effect, gathered openings 14" and 16" to form a more snugly fitting, comfortable garment. The elastic facings 14" and 16", which extend substantially circumferentially about the openings 14, 14' and 16, 16', enable the wearer's appendages to move freely and comfortably while the individual is clothed in the garment but any voids or air spaces which ordinarily might be created due to the loose fitting of conventional garments are avoided and valuable body heat is thus prevented from escaping. In addition, the elastic facings 14" and 16" are resilient enough to retain a snug fit, yet soft enough so as not to allow temporary skin deformation or potential decrease in skin circulation. Furthermore, the elastic facings 14" and 16" are also durable so as to withstand repeated laundering and wear.

Referring more particularly to FIG. 2, a more snug fit is provided by the form-fitting (preferably tailored) make up of garment 10. Double stitched seams 40, are provided at both structural points as well as for the stitching of the front and back panels, 11 and 13, respectively. The purpose of such double stitching is to provide flat seams which will be more comfortable to the wearer.

Figure 3:
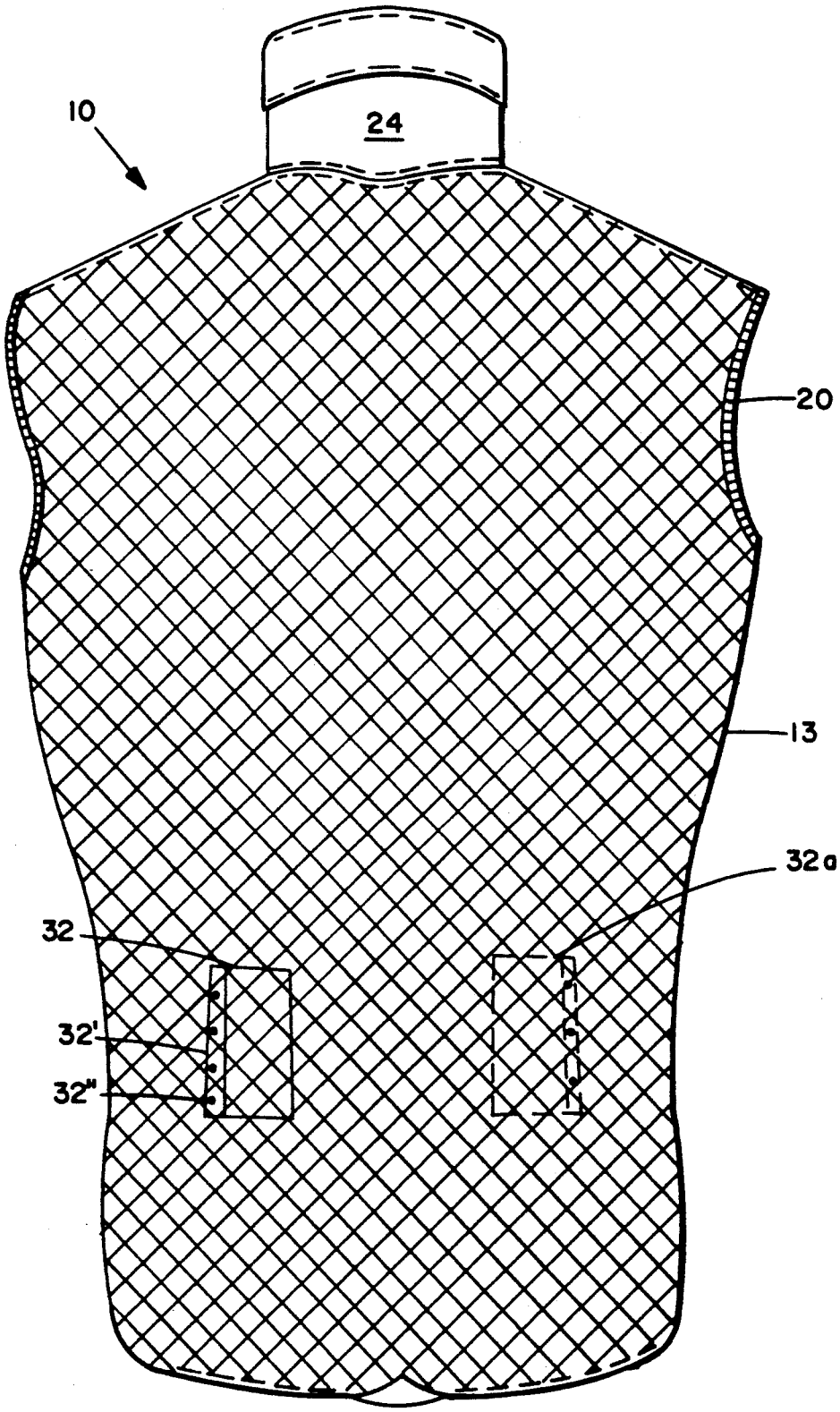
FIG. 3 is a rear perspective view of the FIG. 1, illustrating a therapeutic aid carrying means.

FIG. 3 illustrates the back panel 13 of garment 10 and shows a therapeutic aid carrying means 32 into which therapeutic aids, such as a heating pads, hot water bottles or other physical therapy devices, may be inserted. The therapeutic aid carrying means 32 enables the patient to be treated by the therapeutic aid thereby enabling the patient to remain ambulatory. The therapeutic aid carrying means 32 may be provided with a closure flap 32' so as to insure the aid remains with the patient. The closure flap 32' may additionally be provided with closure means 32" so that the flap 32' may be securely fastened to the carrying means 32. While the therapeutic aid carrying means 32 illustrated in FIG. 3 has a substantially rectangular configuration (e.g. to accept a rectangular heating pad), it will be appreciated that the carrying means should be configured and dimensioned to have a suitable shape and size to accommodate particular therapeutic aids or devices. In addition, it will also be appreciated that more than one therapeutic aid carrying means 32 may be provided (32 and **32*a*) and positioned anywhere on the back panel 13** (e.g. over each of the kidneys).

Figure 4:
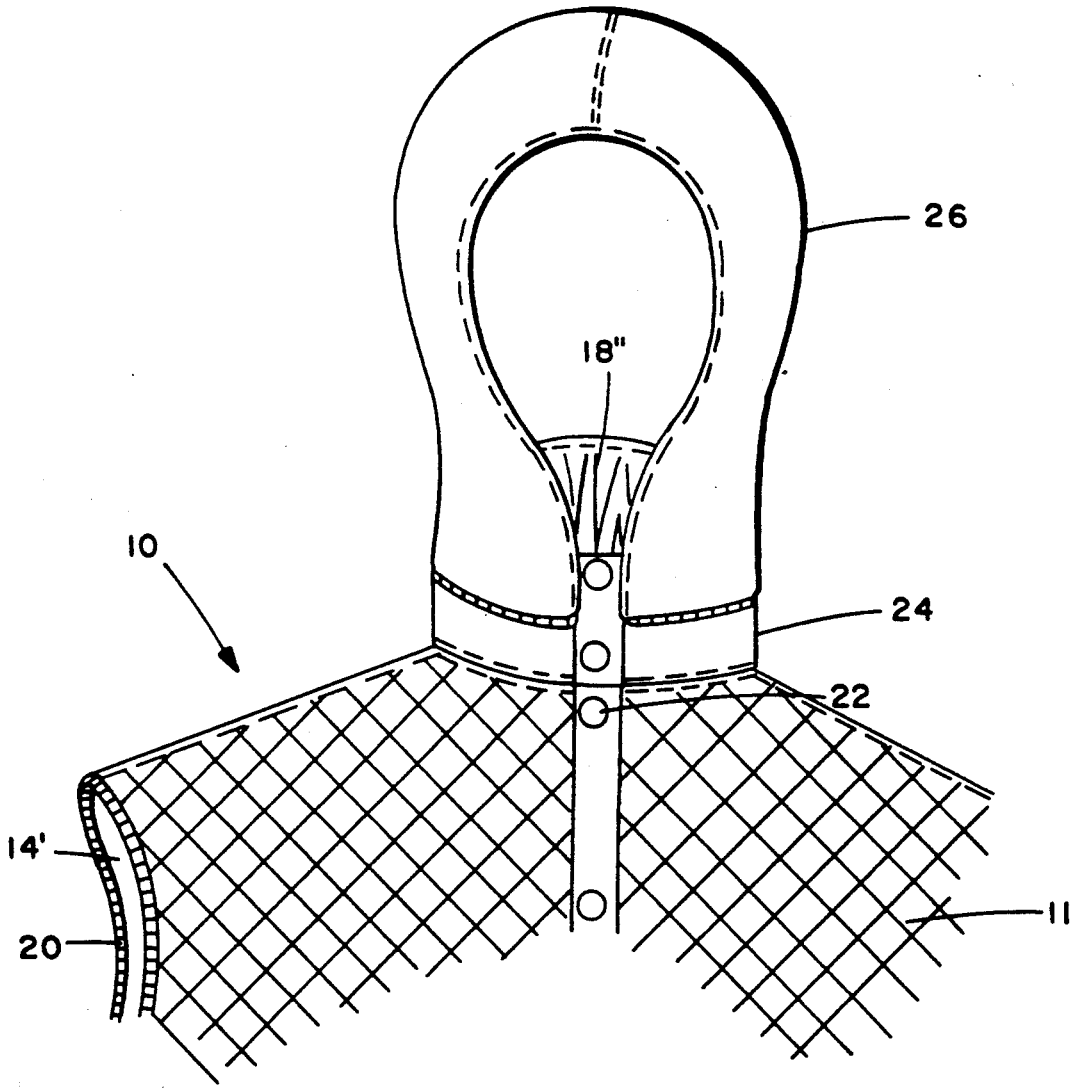
FIG. 4 is a partial front perspective view of the FIG. 1 embodiment, modified to include an integral hood.

FIG. 4 illustrates a further preferred embodiment provided by the present invention including an integral hood 26 connected to collar 24 of the garment 10. The collar 24 is preferably integrally secured to the vest, preferably by double stitching, and extends circumferentially around the neck opening 18. The hood 26, which may or may not be quilted, is preferably constructed from the same material as the garment 10. The hood 26 is securely fastened to the collar 24 by double stitching, stitching from both the inside and outside. Double stitching is provided to insure that the seams lie flat and do not irritate the scalp of the wearer. By permanently securing the hood 26 to the collar 24, the hood 26 is prevented from being separated from the garment 10, thereby insuring that an appropriate head covering is always available to the wearer.

The collar 24 is provided with an elastic facing 18" which surrounds the neck opening 18 in the preferred embodiment. The elastic facing 18" permits the wearer to freely move his or her head without creating any voids or air pockets which would allow precious body heat to escape. In addition, the closure means 22 and strip 23 of the front panel 11 (see FIG. 2), which extends the entire length of the front panel 11 of the garment 10 and includes the collar 24, enables the hood 26 to open flat when the garment 10 is opened and thus no additional effort is required to open the hood 26 when closure means 22 are unfastened. Therefore, the garment 10 and hood 26 lie completely flat when closure means 22 is opened thus making dressing of even non-ambulatory patients more convenient.

Figure 5:
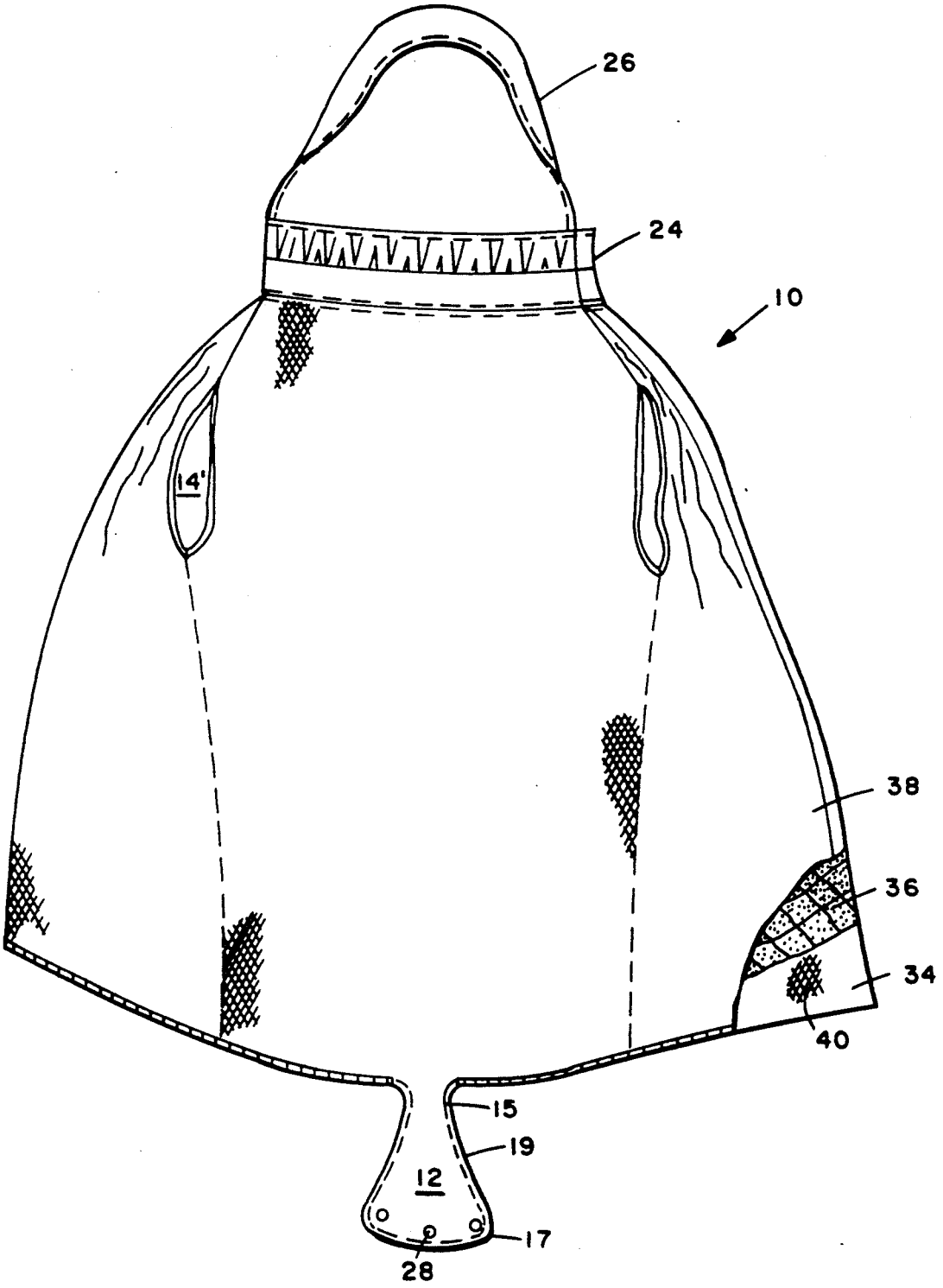
FIG. 5 is a front perspective and partial sectioned view illustrating the FIG. 4 garment in an open position, including a cut away showing the distinct layers of the preferred embodiment sheet.

FIG. 5 illustrates the garment 10 in an open and substantially flat position. The crotch panel 12 has been unfastened along its second end 17 by closure means 28 from the front panel 11 of the garment 10 and is laid open. Permanently securing the crotch panel 12 to panel 13 along end 15 prevents the crotch panel 12 from being separated from the garment 10. To dress a non-ambulatory patient, the garment 10 is spread out in its flat position as shown in FIG. 5, and the patient with his or her back to the to inside of garment 10, is then laid on the open, substantially flat garment 10. The arms of the patient are inserted through arm openings 14 and 14', and the front panel portions **11*a*, 11*b* are folded over the chest of the patient. Closure means 22 is then secured to close the garment 10 to continuously and fully surround the wearer's torso in a snug, form-fitting garment, without any gaps. The crotch panel 12, via closure means 28, is then fastened to the front panel 11**.

Also illustrated in the sectional portion of FIG. 5 are outer 34, intermediate 36 and inner 38 layers comprising panels 11 and 13. In a preferred embodiment, the intermediate layer 36 is made up of a loose filling material to provide insulation to the garment 10, while the outer and inner layers, 34 and 38, respectively, are selected preferably from a group of breathable fabrics. Breathable fabrics are preferable as they allow the skin to transpire as if it were not covered at all. It will be appreciated that the insulation may also be suitable sheet material, i.e. quilt backing. The layers are interconnected to one another by double seams 40 (illustrated in FIGS. 1 and 2). That is one seam is inserted from each of the panels 11 and 13 of the garment to provide a flat seam arrangement which is most comfortable to the wearer. The use of double stitching creates pillowy soft cells 42 (illustrated in FIG. 1) to cushion the wearer and thereby substantially eliminate the contact between the wearer's skin and stitching 40. In addition, the double stitching 40 increases the structural integrity of the garment 10 by having seams sewn in from obverse directions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A one-piece, substantially sleeveless body core warming vest for wearing in direct contact with the skin of the torso of the wearer, comprising:

a multi-layered sheet sized and configured to be snugly worn in a form-fitting manner around the wearer's torso, said sheet comprising:

at least one layer of breathable material and at least one insulative layer secured to said breathable material layer;

closure means, extending longitudinally of said sheet and having closed and opened positions, for securing said sheet to the wearer's torso to provide a snug body conforming fit when in said closed position and for permitting said multi-layered sheet to be opened into a substantially flat position when in said opened position;

arm opening means in said sheet for defining substantially sleeveless arm openings, said arm openings having an elastic facing extending substantially circumferentially there about to provide a gathered, adjustable snug fit;

a semi-rigid, upwardly extending collar integrally connected to said sheet so as to define a neck opening, said collar including an elastic facing so as to provide ease of movement and an adjustable fit for the wearer's neck;

a hood integrally connected to said collar for providing warmth to the wearer's head; and a detachable crotch panel including first and second ends, said crotch panel being integrally attached to said sheet at said first end thereof and further including closure means disposed on said second end thereof for detachably attaching said crotch panel to said sheet.

2. A body core warming vest according to claim 1 wherein said closure means are garment fasteners having an inter-mating relationship.

3. A body core warming vest according to claim 1 wherein said closure means of said crotch panel are disposed substantially perpendicularly to provide lateral strength to a lower abdominal portion of the vest.

4. A body core warming vest according to claim 1 wherein said multi-layered sheet further includes an outer breathable layer which is secured to said insulative layer, opposite said one layer of breathable layer.

5. A body core warming vest according to claim 1 wherein said body core warming vest further includes at least one therapeutic aid receiving means integrally connected to said multi-layered sheet for carrying therapeutic aids.

6. A body core warming vest according to claim 5 wherein said therapeutic receiving means includes a closure flap having fasteners.

7. A body core warming vest according to claim 1 wherein said sheet and said insulative layer are secured to one another by double stitching.

8. A body core warming vest according to claim 7 wherein said double stitching creates pillowy soft cells on said sheet.

9. A one-piece, substantially sleeveless, snug fitting body core warming garment, comprising:

at least first and second sheets of breathable material and including an intermediate insulative sheet so as to form a multi-layered vest structure, and each of said first, second and intermediate sheets being dimensioned to accommodate a human torso;

said multi-layered vest structure being cut and dimensioned to define openings to allow arms, neck and legs of a wearer to protrude, each of said openings having a circumferentially extending elastic facing;

inter-mating closure means disposed on at least one of said first and second sheets to secure said vest structure to the wearer's torso;

at least one therapeutic aid receiving means disposed on said first sheet and sized and configured to receive at least one therapeutic treatment device;

a collar secured to said multi-layered vest and extending circumferentially about said opening for the wearer's neck;

a hood integrally connected to said collar for providing a head covering; and a detachable crotch panel including first and second ends, said first end being permanently secured to a back side of said first sheet and said second end having closure means for releasably attaching said crotch panel.

10. A body core warming garment according to claim 9 wherein said closure means are garment fasteners.

11. A body core warming garment according to claim 9 wherein said therapeutic aid receiving means is provided with a closure flap having fasteners.

12. A body core warming garment according to claim 9 wherein said closure means is disposed along an entire longitudinal length of said second sheet.

13. A body core warming garment according to claim 9 wherein said closure means of the crotch panel is disposed substantially perpendicularly to said closure means of the vest.

14. A body core warming garment according to claim 9 wherein said multi-layer vest is double stitched.

15. A body core warming garment according to claim 14 wherein said double stitching creates pillowy soft cells on said first and second sheets.

16. A sleeveless body core warming vest, comprising:

a multi-layer, insulated fabric cut and dimensioned to snugly surround a torso of a wearer, said fabric defining cut-out portions for the neck, arms and legs of the wearer;

a collar extending circumferentially about said cut-out for the neck, said collar having an elastic facing to provide a snug and adjustable fit;

a hood integrally connected to said collar for covering a wearer's head;

closure means disposed on at least a first surface of said multi-layer fabric for securing the vest in a closed position to the wearer;

a crotch panel having first and second ends, securing at least said first end to said multi-layer fabric; and said multi-layer fabric and said crotch panel opens substantially flat to enable the wearer to be easily clad in the vest.

17. A torso-enclosing, substantially sleeveless, form-fitting body core warming garment comprising:

a shaped, breathable fabric construction enclosing the torso of a wearer, said fabric construction being worn in direct contact with the wearer's skin while permitting moisture to escape from said skin; and closure means having an open position and a closed position, said closure means for securing said fabric construction to said torso in a snug, form-fitting manner when in said closed position, said closure means including a crotch panel defining first and second leg openings at least when said closure means is in said closed position, said crotch panel in use helping to retain said fabric construction around the lower part of said torso in said form fitting manner, said closure means allowing said fabric construction to be opened into a substantially flat configuration when said closure means is in said opened position, said fabric construction in use effectively retaining heat radiated by the body.

* * * * *